US011913331B1

(12) United States Patent
Milkovisch et al.

(10) Patent No.: US 11,913,331 B1
(45) Date of Patent: Feb. 27, 2024

(54) SYSTEMS AND METHODS FOR RECOVERING AND PROTECTING SIDEWALL CORE SAMPLES IN UNCONSOLIDATED FORMATIONS

(71) Applicant: Schlumberger Technology Corporation, Sugar Land, TX (US)

(72) Inventors: Mark Milkovisch, Cypress, TX (US); Amol Bhome, Richmond, TX (US); Joseph Casassa, Sugar Land, TX (US); Anish Kumar, Katy, TX (US); Daniel De La Garza, Alvin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/822,326

(22) Filed: Aug. 25, 2022

(51) Int. Cl.
*E21B 49/06* (2006.01)

(52) U.S. Cl.
CPC ..... *E21B 49/06* (2013.01)

(58) Field of Classification Search
CPC ..... E21B 25/04; E21B 49/06
See application file for complete search history.

(56) References Cited

U.S. PATENT DOCUMENTS 4,518,051 A * 5/1985 Sollie ..... E21B 25/04 73/864.45
5,445,228 A * 8/1995 Rathmell ..... E21B 43/119 175/4
2003/0078610 A1* 4/2003 Yedlowski ..... A61F 13/046 606/179
2008/0066534 A1* 3/2008 Reid ..... E21B 36/001 73/152.13
2008/0078582 A1 4/2008 Phan et al.
2009/0133932 A1* 5/2009 Church ..... E21B 49/06 175/44
2013/0066605 A1* 3/2013 Li ..... G01N 23/223 703/2
2013/0081879 A1* 4/2013 Ward ..... E21B 10/02 175/94
2014/0208826 A1 7/2014 Larter et al.
(Continued)

FOREIGN PATENT DOCUMENTS

WO 2020096874 A1 5/2020

OTHER PUBLICATIONS

PCT International Search Report and Written Opinion; Application No. PCT/US2023/031114; dated Dec. 6, 2023; 10 pages.

*Primary Examiner* — Shane Bomar
(74) *Attorney, Agent, or Firm* — Jeffrey D. Frantz

(57) ABSTRACT

Systems and methods presented herein include sidewall coring tools used to return core samples of rock from a sidewall of a wellbore as part of a data collection exercise for exploration and production of hydrocarbons. In particular, the systems and methods presented herein perform sidewall coring of a subterranean formation using a combination of rotary and percussive coring. More specifically, the systems and methods presented herein rotate a coring cylinder of a sidewall coring tool back and forth less than a full rotation while pushing the coring cylinder of the sidewall coring tool against a bore wall of a wellbore, and push the coring cylinder of the sidewall coring tool into the subterranean formation to enable extraction of a core sample of the subterranean formation.

19 Claims, 7 Drawing Sheets

(56) References Cited

U.S. PATENT DOCUMENTS

| | | | | |
|---|---|---|---|---|
| 2015/0354352 | A1* | 12/2015 | Ezzat | G01N 15/0826 73/152.05 |
| 2016/0053564 | A1 | 2/2016 | Haley et al. | |
| 2019/0234204 | A1* | 8/2019 | Moronkeji | E21B 47/14 |
| 2021/0246731 | A1 | 8/2021 | West et al. | |
| 2021/0389294 | A1* | 12/2021 | Krueger | G01N 33/24 |

* cited by examiner

SYSTEMS AND METHODS FOR RECOVERING AND PROTECTING SIDEWALL CORE SAMPLES IN UNCONSOLIDATED FORMATIONS

BACKGROUND

The present disclosure relates generally to systems and methods for performing sidewall coring within a wellbore. More specifically, the present disclosure relates to using muleshoes or other coring cylinders (e.g., cylinders with cutting knife edge(s)) actuated by actuators to perform sidewall coring within a wellbore extending through an unconsolidated (or poorly consolidated or poorly cemented) formation.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, and/or extraction of resources. These resources may include oil, gas, water, or any other combination of elements within the ground.

Wellbores or boreholes may be drilled to, for example, locate and produce hydrocarbons. During a well development operation, it may be desirable to evaluate and/or measure properties of encountered formations, formation fluids and/or formation gasses. Some formation evaluations may include extracting a core sample (e.g., a rock sample) from the sidewall of a wellbore. Core samples may be extracted using a coring tool coupled to a downhole tool that is lowered into the wellbore and positioned adjacent a formation. A hollow coring shaft or bit of the coring tool may be extended from the downhole tool and urged against the formation to penetrate the formation. A formation or core sample fills the hollow portion or cavity of the coring shaft and the coring shaft is removed from the formation retaining the sample within the cavity.

The sample obtained using the hollow coring bit (or bullet) is generally referred to as a "core sample" or "core plug." Once the core sample has been transported to the surface, it may be analyzed to assess, among other things, the reservoir storage capacity (e.g., porosity) and the flow potential (e.g., permeability) of the material that makes up the formation; the chemical and mineral composition of the fluids and mineral composition of the rock, including deposits contained in the pores of the formation; and the irreducible water content of the formation material. The information obtained from analysis of a sample is used to design and implement well completion and production facilities.

SUMMARY

A summary of certain embodiments described herein is set forth below. It should be understood that these aspects are presented merely to provide the reader with a brief summary of these certain embodiments and that these aspects are not intended to limit the scope of this disclosure.

The systems and methods presented herein include a method that includes deploying a sidewall coring tool into a wellbore extending through a subterranean (e.g., including offshore) formation. The method also includes rotating a coring cylinder of the sidewall coring tool back and forth less than a full rotation while pushing the coring cylinder of the sidewall coring tool against a bore wall of the wellbore. The method further includes pushing the coring cylinder of the sidewall coring tool into the subterranean formation to enable extraction of a core sample of the subterranean formation. In addition, the method includes retracting the coring cylinder to retrieve the core sample of the subterranean formation.

The systems and methods presented herein also include a sidewall coring tool includes a coring cylinder and one or more actuators. The one or more actuators are configured to rotate the coring cylinder back and forth less than a full rotation while pushing the coring cylinder against a bore wall of a wellbore. The one or more actuators are also configured to push the coring cylinder into the subterranean formation to enable extraction of a core sample of a subterranean (e.g., including offshore) formation.

The systems and methods presented herein further include a coring system includes a sidewall coring tool having a coring cylinder and one or more actuators configured to perform sidewall coring of a subterranean (e.g., including offshore) formation using a combination of rotary and percussive coring. The coring system also includes a surface unit configured to send control signals to the sidewall coring tool to control the sidewall coring of the subterranean formation.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

Figure 1:
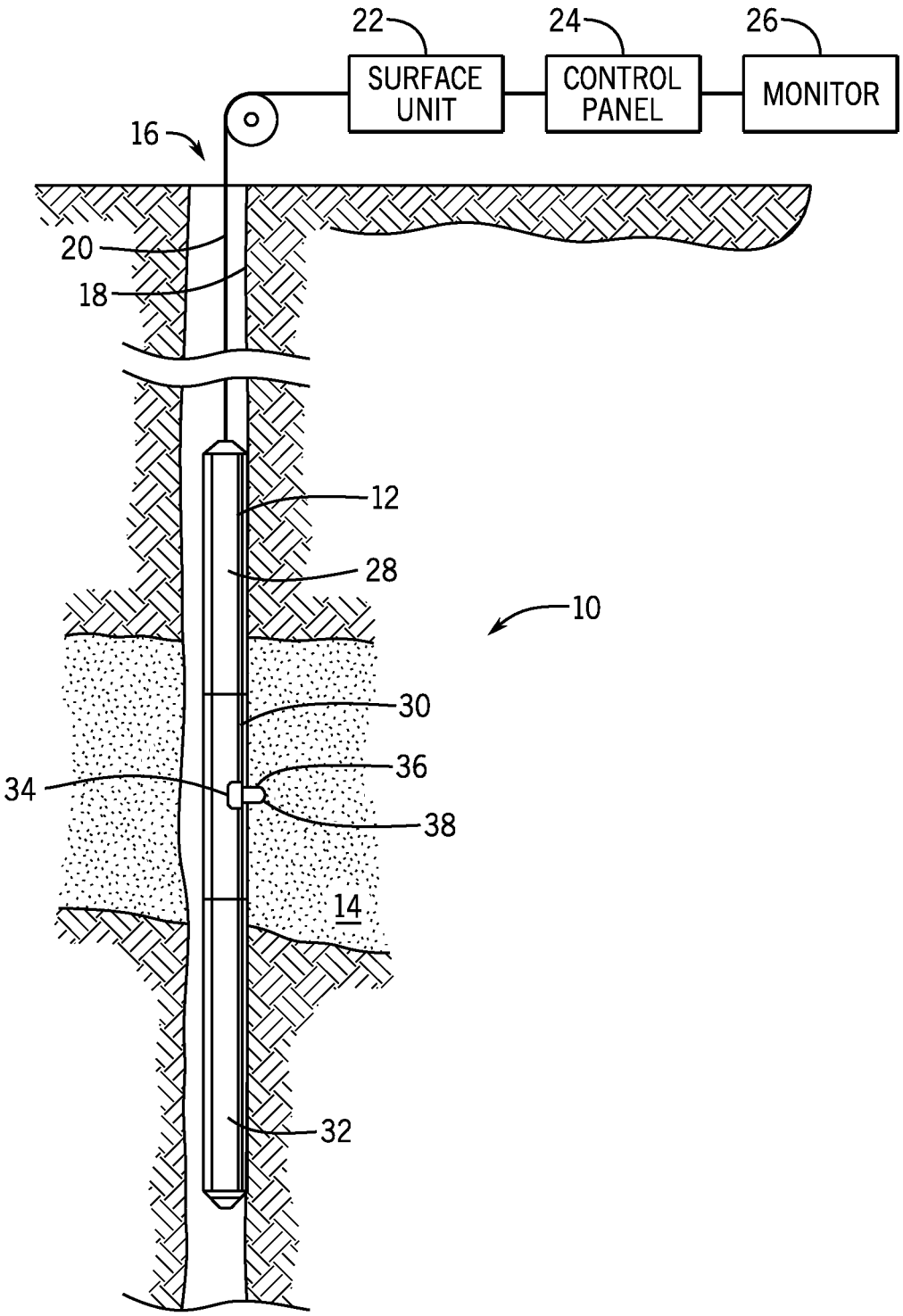
FIG. 1 is a schematic view of an embodiment of a coring system, according to one or more embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements; in other words, these terms are used in an open-ended fashion, and thus should be interpreted to mean "including, but not limited to . . . ." Additionally, it should be understood that references to "one embodiment" or "an embodiment" of the present disclosure are not intended to be interpreted as excluding the existence of additional embodiments that also incorporate the recited features. Furthermore, the phrase "A based on B" is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As described above, mechanical sidewall coring tools use a coring bit or cylinder to cut into an annular space in the wellbore to create a cylindrical core sample or plug that can be extracted to the surface. A plurality of core samples or plugs can be cut and stored (usually sequentially) and returned to the surface for analysis. The embodiments described herein relate to sidewall coring tools having coring bits or coring shafts that may be used to collect samples (e.g., rock samples, tar sand samples, etc.) from subterranean formations adjacent a borehole or a wellbore. The example coring shafts generally include a cylindrical body coupled to a coring bit having a leading edge (e.g., bit face) to contact and penetrate a subterranean formation to be sampled. The cylindrical body has an internal cavity defined at least in part by an inner surface of the cylindrical body to collect the samples.

Referring now to the drawings, FIG. 1 is a schematic view of an embodiment of a coring system 10 utilizing a sidewall coring tool 12 as described in greater detail herein. As illustrated, the sidewall coring tool 12 may be used in a drilled well to obtain core samples from a downhole or subterranean (e.g., including offshore) formation 14. In operation, the sidewall coring tool 12 may be lowered into a wellbore 16 with an internal wall, commonly referred to as the bore wall 18. As illustrated, in certain embodiments, the sidewall coring tool 12 may be connected by one or more electrically conducting cables 20 (e.g., wireline cables) to a surface unit 22, which may include (or otherwise be operatively coupled to) a control panel 24 and a monitor 26. In general, the surface unit 22 is configured to provide electrical power to the sidewall coring tool 12, to monitor the status of downhole coring and activities of other downhole equipment, and to control the activities of the sidewall coring tool 12 and other downhole equipment. While FIG. 1 illustrates the sidewall coring tool 12 deployed at the end of a wireline cable 20, in other embodiments, a sidewall coring tool 12 may be deployed in a well using any known or future-developed conveyance means, including drill pipe, coiled tubing, etc.

In certain embodiments, the sidewall coring tool 12 may be contained within an elongated housing suitable for being lowered into and retrieved from the wellbore 16. In certain embodiments, the sidewall coring tool 12 may include an electronic sonde 28, a mechanical sonde 30, and a core storage chamber 32. In general, the electronic sonde 28 includes electronics that enable the sidewall coring tool 12 to communicate with the surface unit 22 (e.g., though the cables 20) and to control coring operations of the sidewall coring tool 12 in accordance with such communication. In addition, the mechanical sonde 30 includes mechanical components that enable the sidewall coring tool 12 to retrieve core samples through the bore wall 18 of the wellbore 16, as described in greater detail, and to store the retrieved core samples (e.g., as sequentially retrieved) in the core storage chamber 32.

In particular, as described in greater detail herein, the mechanical sonde 30 may contain a coring assembly including at least one coring actuator 34 powered through the cables 20, a (generally cylindrical) coring cylinder 36 having a distal, open axial end 38 for cutting and receiving a core sample from a formation 14 into an internal cavity formed radially within the coring cylinder 36, and a mechanical linkage (not shown) for deploying and retracting the coring cylinder 36 relative to the sidewall coring tool 12, as described in greater detail herein. FIG. 1 illustrates the sidewall coring tool 12 in an active, cutting configuration. As described in greater detail herein, the distal, open axial end 38 of the coring cylinder 36 may be moved via the coring actuator 34 against the formation 14 to cut a core sample from the formation 14.

The embodiments described herein provide systems and methods for improving the recovery and quality of subterranean sidewall core samples in unconsolidated formations 14 with relatively low Unconfined Compressive Strength (UCS) (e.g., less than 800 psi UCS). This is even more challenging in subterranean environments with relatively high pressure (e.g., greater than 25 ksi). For example, coring and recovery become even more challenging with increasing formation pore pressure and increasing mud weight and associated hydrostatic pressure.

As used herein, the term "unconsolidated" is intended to refer to formations 14 having uncemented to poorly cemented grains (regardless of the actual grain size, though it would be a fraction of the bit inner diameter). For coring planning purposes, the term "unconsolidated" may be used based on the measured or computed values of UCS in the following manner:

UCS <~400 psi: unconsolidated formation

UCS of ~400 psi to ~700 psi: poorly consolidated formation

UCS of ~700 psi to ~1,000 psi: poorly to moderately consolidated formation

UCS of ~1,000 psi to ~2,000 psi: moderately consolidated formation

UCS >~2,000 psi: consolidated formation

Traditionally, sidewall core samples are predominately extracted by one of two means—percussive sidewall coring or rotary sidewall coring. Rotary sidewall coring mainly uses a coring bit to drill out the core sample (e.g., like a hole saw). This method works very well for relatively hard rocks, but poorly for unconsolidated formations 14. In general, the drilling rotation causes vortexes with the cuttings and downhole fluids that destroy samples with relatively low UCS (e.g., 100-300 psi) or unconsolidated formations 14 (e.g., including sand, sandstone, shale, shaly sand, sandy shale, other low UCS rock types, and so forth). Additionally, with the downhole pressure, while drilling the differential pressure between the wellbore 16 and the formation 14 tries to pull back cuttings, causing the bit to stall. As such, the coring bit often needs to be pulled back several times to clear the cuttings to recover a single core. The rotation of the coring bit and these additional actions cause damage to the core sample, leading to poor quality that are often not recoverable. Percussive coring, on the other hand, uses shape charges that shoot cups (e.g., hollow bullets) into the rock that are tethered to the sidewall coring tool. Percussive coring is often better at capturing softer cores, but it generally tends to destroy the integrity of the core due to the relatively high shock.

The embodiments described herein combine both methods in a single sidewall coring tool 12. In particular, instead of using a rotating bit to drill into the formation 14 like as done on a rotary sidewall coring tool, the sidewall coring tool 12 described herein uses a coring cylinder 36 to cut and penetrate into the formation 14. Similarly to rotary sidewall coring, after being axially pushed against a surface of the formation 14, the sidewall coring tool 12 described herein is configured to rotate the coring cylinder 36 back and forth, but only less than a full rotation (e.g., 360 degrees), for example, less than ¾ turn (e.g., 270 degrees), less than ½ turn (e.g., 180 degrees), or approximately 90 degrees (e.g., within a range of between 85-95 degrees, between 86-94 degrees, between 87-93 degrees, between 88-92 degrees, between 89-91 degrees, and so forth) relative to a longitudinal axis of the coring cylinder 36, while applying axial force such that the rotation of the coring cylinder 36 begins forming the core sample, at each coring station. After initially forming a small portion of the core sample, similar to percussive sidewall coring, using hydraulics and a coring actuator 34, the rotating coring cylinder 36 is then pushed axially into the formation 14, thereby further forming the core sample.

Figure 2:
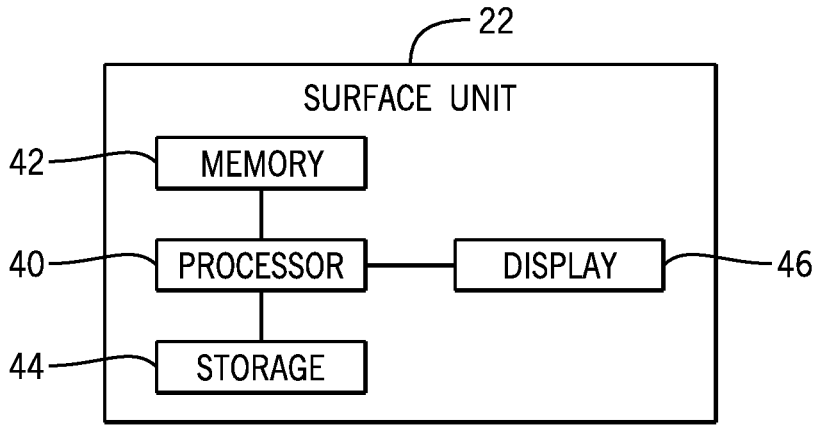
FIG. 2 is a schematic diagram of a surface unit of the coring system of FIG. 1, according to one or more embodiments of the present disclosure.

FIG. 2 is a schematic diagram of the surface unit 22 of the coring system 10 of FIG. 1. As illustrated, in certain embodiments, the surface unit 22 may include one or more processor(s) 40, memory media 42, storage media 44, and/or a display 46. In certain embodiments, the surface unit 22 may send control signals to, among other things, the coring actuators 34 of the sidewall coring tools 12 to enable the coring actuators 34 to cause the rotation and axial movement of the respective coring cylinders 36, as described in greater detail herein. In particular, the processor(s) 40, using instructions stored in the memory media 42 and/or storage media 44, may determine when and how to control operational parameters of the sidewall coring tools 12. As such, the memory media 42 and/or the storage media 44 of the surface unit 22 may be any suitable article of manufacture that can store the instructions. The memory media 42 and/or the storage media 44 may be read-only memory (ROM), random-access memory (RAM), flash memory, an optical storage medium, or a hard disk drive, to name a few examples. The display 46 may be any suitable electronic display that can display logs, indices, and/or indicators that enable monitoring of operation of the sidewall coring tools 12, as described in greater detail herein. In certain embodiments, the sidewall coring tool 12 may include processing circuitry similar to the surface unit 22 to enable the sidewall coring tool 12 to at least partially control the rotation and axial movement of its respective coring cylinder 36, as described in greater detail herein.

Figure 3:
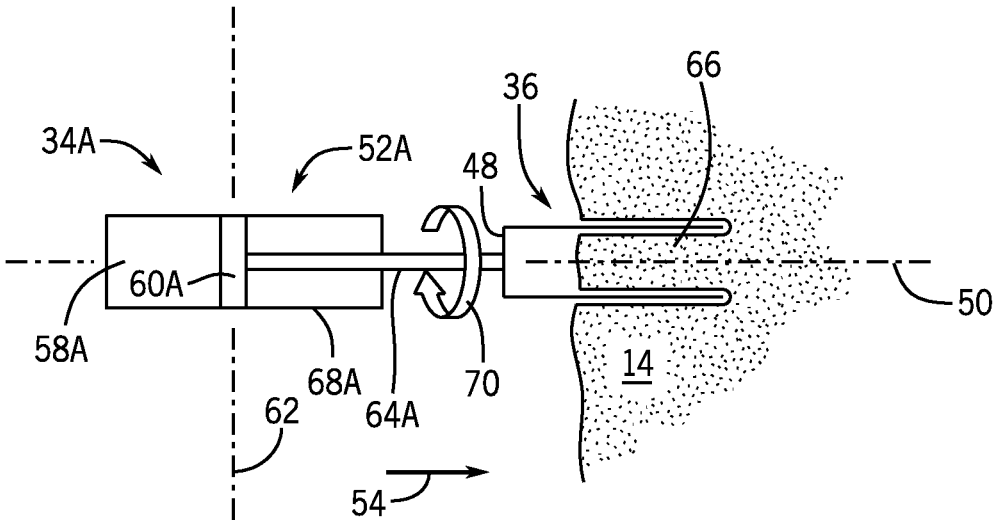
FIG. 3 illustrates a coring actuator of a sidewall coring tool that includes a hydraulic piston, according to one or more embodiments of the present disclosure.
Figure 4:
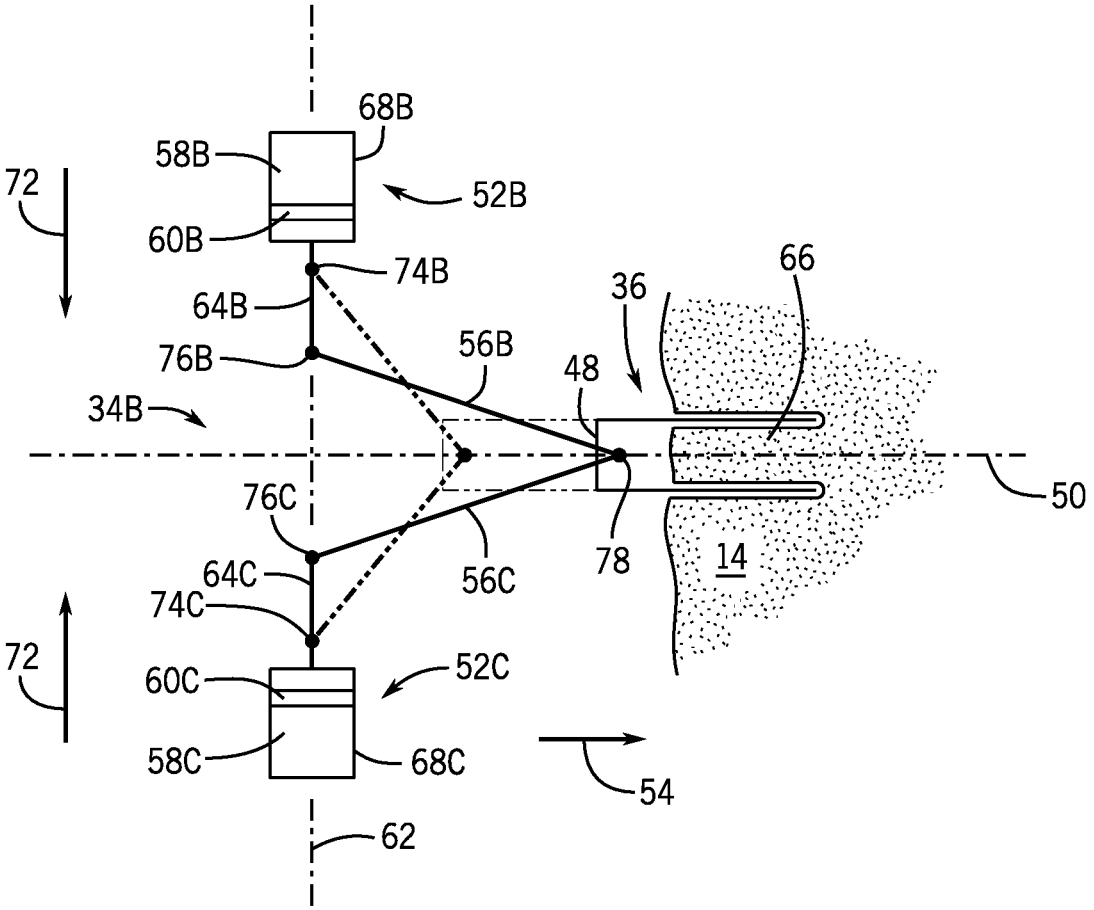
FIG. 4 illustrates a coring actuator of a sidewall coring tool that includes a set of opposing hydraulic pistons, according to one or more embodiments of the present disclosure.

The sidewall coring tool 12 may utilize various different types of coring actuators 34 to cause the rotation and the axial movement of the coring cylinder 36, as described in greater detail herein. FIGS. 3 and 4 illustrate two non-limiting examples of such coring actuators 34 of the sidewall coring tool 12. In particular, FIG. 3 illustrates a coring actuator 34A of the sidewall coring tool 12 that includes a hydraulic piston 52A that may directly cause axial movement 54 of the coring cylinder 36 into the formation 14, and FIG. 4 illustrates a coring actuator 34B of the sidewall coring tool 12 that includes a set of opposing hydraulic pistons 52B, 52C that may indirectly cause the axial movement 54 of the coring cylinder 36 into the formation 14 via connections to linkages 56B, 56C that are coupled to both the respective hydraulic piston 52B, 52C and the axial end 48 of the coring cylinder 36. Although illustrated in FIGS. 3 and 4 as being hydraulic actuators 34A, 34B that include hydraulic pistons 52A, 52B, 52C, in other embodiments, the actuators 34 described herein may utilize other actuation means including, but not limited to, electric actuation, electromagnetic actuation, magnetic actuation, mechanical actuation, or some combination thereof.

As illustrated in FIG. 3, injection of hydraulic fluid into a piston chamber 58A of the hydraulic piston 52A causes a piston head 60A of the hydraulic piston 52A to move away from a transverse axis 62 of the sidewall coring tool 12 (and toward the formation 14), which in turn causes a piston rod 64A of the hydraulic piston 52A, which is coupled to the axial end 48 of the coring cylinder 36, to push the coring cylinder 36 into the formation 14, as illustrated by arrow 54, to enable extraction of a core sample 66.

It will be appreciated that the hydraulic piston 52A of the coring actuator 34A illustrated in FIG. 3 may be a linear hydraulic piston 52A whereby the piston rod 64A is configured to move linearly relative to a cylinder 68A of the hydraulic piston 52A. In addition, in certain embodiments, the piston head 60A and the piston rod 64A of the hydraulic piston 52A may be configured to be rotated about a longitudinal axis 50 of the hydraulic piston 52A (and the coring cylinder 36), as illustrated by arrow 70, while applying force against the formation 14 via the coring cylinder 36, prior to the axial movement 54 of the coring cylinder 36.

In contrast, as opposed to having a single hydraulic piston 52A that is configured to directly actuate the coring cylinder 36, in other embodiments, the coring actuator 34B illustrated in FIG. 4 includes two opposing hydraulic pistons 52B, 52C that are longitudinally aligned with the transverse axis 62 of the sidewall coring tool 12. As illustrated in FIG. 4, injection of hydraulic fluid into piston chambers 58B, 58C of the hydraulic pistons 52B, 52C causes piston heads 60B, 60C of the hydraulic pistons 52B, 52C to move toward each other along the transverse axis 62 of the sidewall coring tool 12, as illustrated by arrows 72, which in turn causes piston rods 64B, 64C of the hydraulic piston 52B, 52C, which are coupled to respective linkages 56B, 56C that are coupled to the axial end 48 of the coring cylinder 36, to push the coring cylinder 36 into the formation 14, as illustrated by arrow 54, to enable extraction of a core sample 66.

It will be appreciated that the hydraulic pistons 52B, 52C of the coring actuator 34B illustrated in FIG. 4 may have piston rods 64B, 64C that are coupled to their respective piston heads 60B, 60C at rod connection joints 74B, 74C that enable the piston rods 64B, 64C to rotate about the rod connection joints 74B, 74C (e.g., as opposed to the rigidly-coupled linear piston head 60A and piston rod 64A of the hydraulic piston 52A of the coring actuator 34A illustrated in FIG. 3). In addition, as also illustrated in FIG. 4, the piston rods 64B, 64C are each rotationally coupled to respective linkages 56B, 56C (e.g., at linkage connection joints 76B, 76C) such that the axial movement 72 of the piston heads 60B, 60C of the hydraulic pistons 52B, 52C indirectly causes the linkages 56B, 56C to cause the axial movement of the coring cylinder 36 into the formation 14 (e.g., via a coring cylinder connection joint 78 that rotationally couples the linkages 56B, 56C to the coring cylinder 36). In addition, in certain embodiments, the piston rods 64B, 64C of the hydraulic pistons 52B, 52C may also be configured to rotate along a plane of the transverse axis 62 of the sidewall coring tool 12 (e.g., into or out of FIG. 4) to indirectly cause (e.g., via the respective linkages 56B, 56C) the coring cylinder 36 to rotate about the longitudinal axis 50 of the coring cylinder 36, as illustrated by arrow 70, while applying force against the formation 14 via the coring cylinder 36, prior to the axial movement 54 of the coring cylinder 36.

In certain embodiments, after the core sample 66 has been formed, the process for rotating the coring cylinder 36 back and forth less than a full rotation (e.g., 360 degrees), for example, less than ¾ turn (e.g., 270 degrees), less than ½ turn (e.g., 180 degrees), or approximately 90 degrees (e.g., within a range of between 85-95 degrees, between 86-94 degrees, between 87-93 degrees, between 88-92 degrees, between 89-91 degrees, and so forth) relative to a longitudinal axis of the coring cylinder 36, may be performed by the coring actuator 34 to break any mud-seal formed between the coring cylinder 36 and the formation 14. In other embodiments, the mud-seal may be broken using relatively rapid axial movement of the coring cylinder 36 at a relatively small amplitude. Then, reverse axial motion of the coring cylinder 36 may be performed by the coring actuator 34, for example, by reversing the axial movement steps discussed with reference to FIGS. 3 and 4 to extract the core sample 66. In addition, in certain embodiments, the core sample 66 may be extracted at least partially using suction created by the sidewall coring tool 12 within the internal cavity formed radially within the coring cylinder 36.

Figure 5:
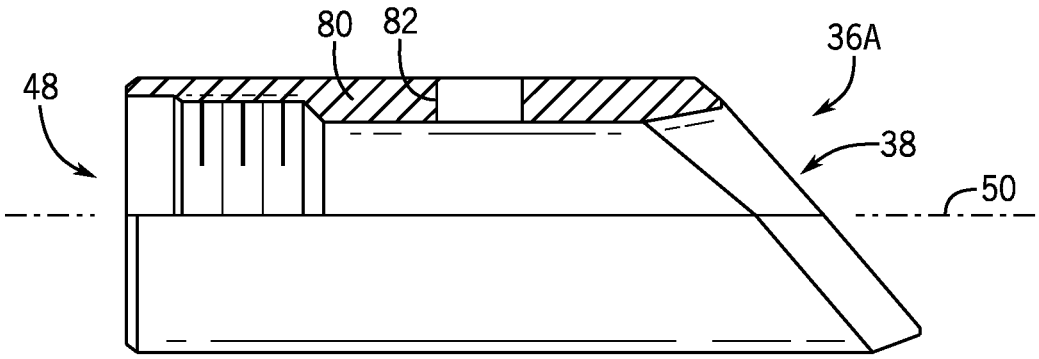
FIG. 5 is a cutaway side view of a full muleshoe of a sidewall coring tool of the coring system of FIG. 1, according to one or more embodiments of the present disclosure.
Figure 6:
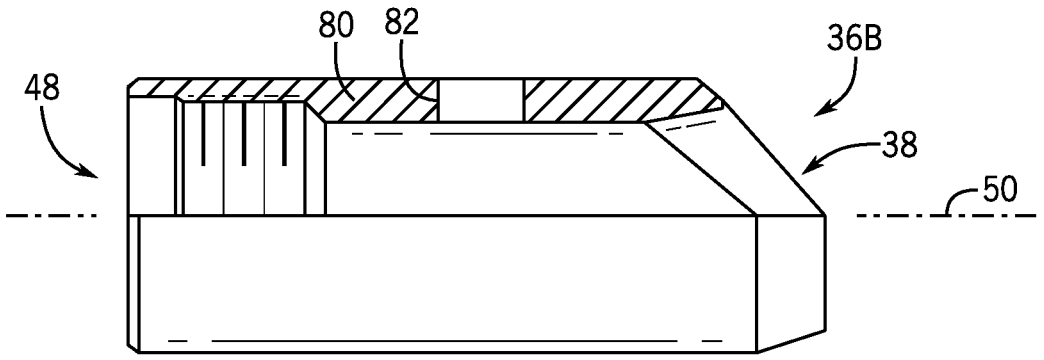
FIG. 6 is a cutaway side view of a half muleshoe of a sidewall coring tool of the coring system of FIG. 1, according to one or more embodiments of the present disclosure.

In certain embodiments, the coring cylinder 36 may take the form of a muleshoe, half muleshoe, or other muleshoe. As used herein, the term "muleshoe" is used to mean a relatively short length of cylindrical tubing having an axial end of the tubing angled (e.g., 45 degrees, between 40-50 degrees, between 35-55 degrees, between 30-60 degrees, and so forth) relative to its longitudinal axis. For example, FIGS. 5 and 6 are cutaway side views of a full muleshoe 36A and a half muleshoe 36B of the sidewall coring tool 12 of the coring system 10 of FIG. 1, respectively. As illustrated, each muleshoe 36 includes a cylindrical tubular body 80 that includes an angled axial end 38 (e.g., an axial end farthest away from the sidewall coring tool 12. Specifically, the opposite axial end 48 is closest to the sidewall coring tool 12 and is the axial end that is actuated by the sidewall coring tool 12 to move the muleshoe 36 into a formation 14 to extract a sidewall core sample, as described in greater detail herein. The main difference between the full muleshoe 36A illustrated in FIG. 5 and the half muleshoe 36B illustrated in FIG. 6 is that only approximately half of the axial end 38 of the half muleshoe 36B illustrated in FIG. 6 is angled, wherein the entirety of the axial end 38 of the full muleshoe 36A illustrated in FIG. 5 is angled. It will be appreciated that other types of partial muleshoes 36 (e.g., having only a portion of the axial end 38 of the muleshoe 36 angled).

In addition, in other embodiments, the sidewall coring tool 12 described herein may instead utilize cylindrical coring tubing not having an angled axial end, such as the muleshoes 36 illustrated in FIGS. 5 and 6. However, the muleshoes 36 illustrated in FIGS. 5 and 6 may be particularly effective at cutting into the formation 14 when the respective muleshoe 36 is pushed against the formation 14 and rotated about its longitudinal axis 50 (e.g., to begin forming the core sample) before being further axially pushed into the formation 14 (e.g., to further form the core sample), as described in greater detail herein.

Figure 7:
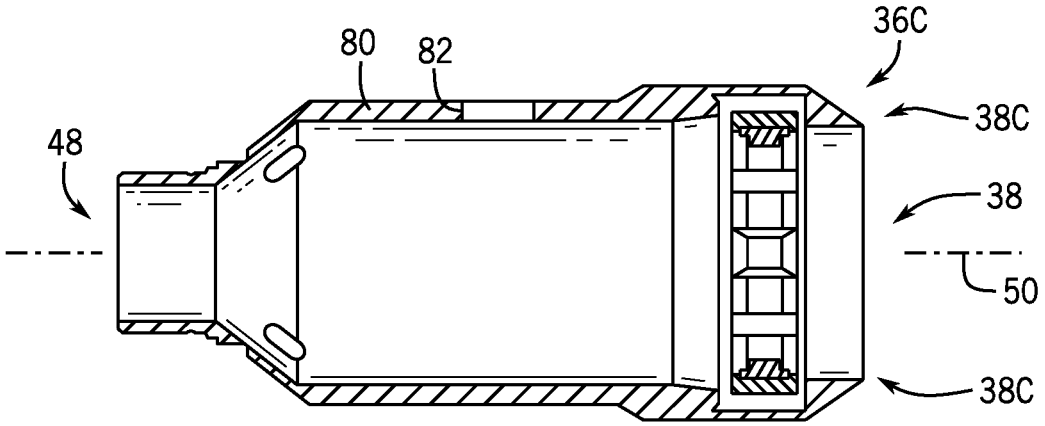
FIG. 7 is a cutaway side view of another coring cylinder (e.g., having a "knife edge") of the sidewall coring tool of the coring system of FIG. 1, according to one or more embodiments of the present disclosure.

FIG. 7 is a cutaway side view of another coring cylinder 36C (e.g., having a knife edge) of the sidewall coring tool 12 of the coring system 10 of FIG. 1. As illustrated in FIG. 7, the coring cylinder 36C does not include a muleshoe, half muleshoe, or other partial muleshoe 36. Rather, the coring cylinder 36C illustrated in FIG. 7 includes cylindrical coring tubing not having an angled axial end, but rather having "knife edge" (e.g., triangular) points 38C formed at the axial end 38 of the coring cylinder 36C that enable the coring cylinder 36C to more effectively cut into the formation 14 when the coring cylinder 36 is axially pushed into the formation 14, as described in greater detail herein. In addition, in certain embodiments, the coring cylinders 36 described herein may include serrated edge axial ends (e.g., having a plurality of serrated teeth).

Returning now to FIGS. 5 and 6, in certain embodiments, the muleshoes 36A, 36B may include one or more debris holes 82 through walls of the cylindrical tubular bodies 80 of the muleshoes 36A, 36B that enable fluids, mud, debris, and so forth, to be displaced from interiors of the muleshoes 36A, 36B, which in turn enables the muleshoes 36A, 36B to penetrate the formation 14, as described in greater detail herein. It will be appreciated that the coring cylinder 36C illustrated in FIG. 3 may also include one or more similar debris holes 82 through the wall of the cylindrical tubular body 80 of the coring cylinder 36.

Figure 8A:
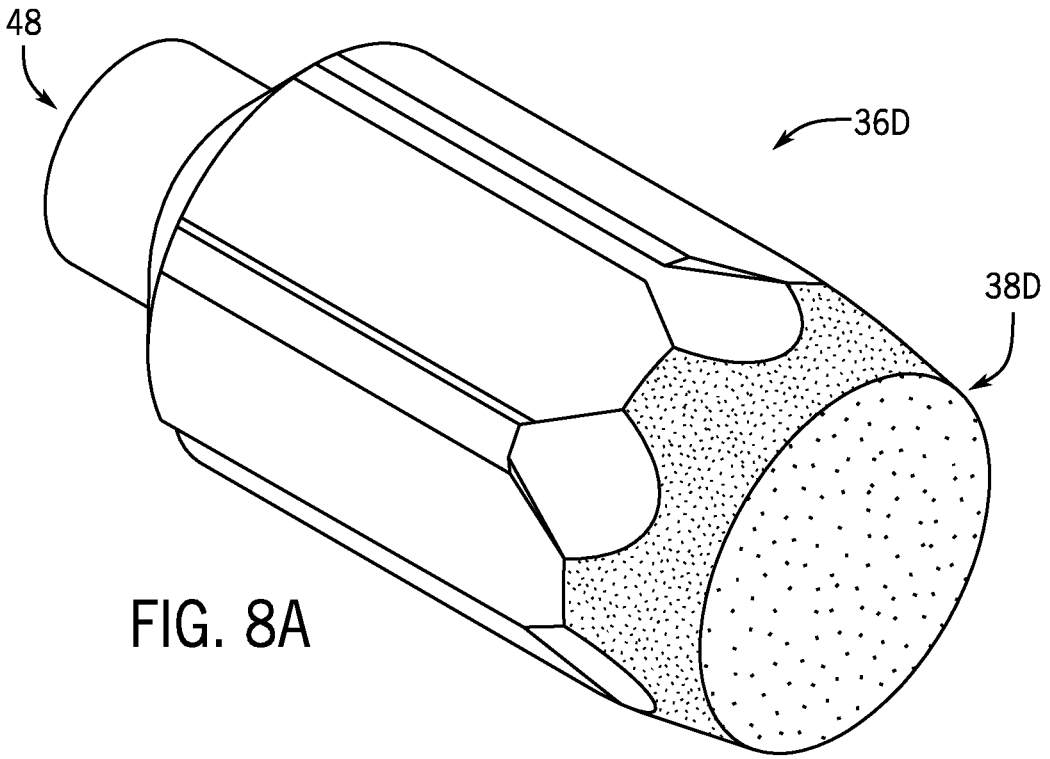
FIGS. 8A through 8C illustrate various embodiments of coring cylinders having a "knife edge", according to one or more embodiments of the present disclosure.
Figure 8B:
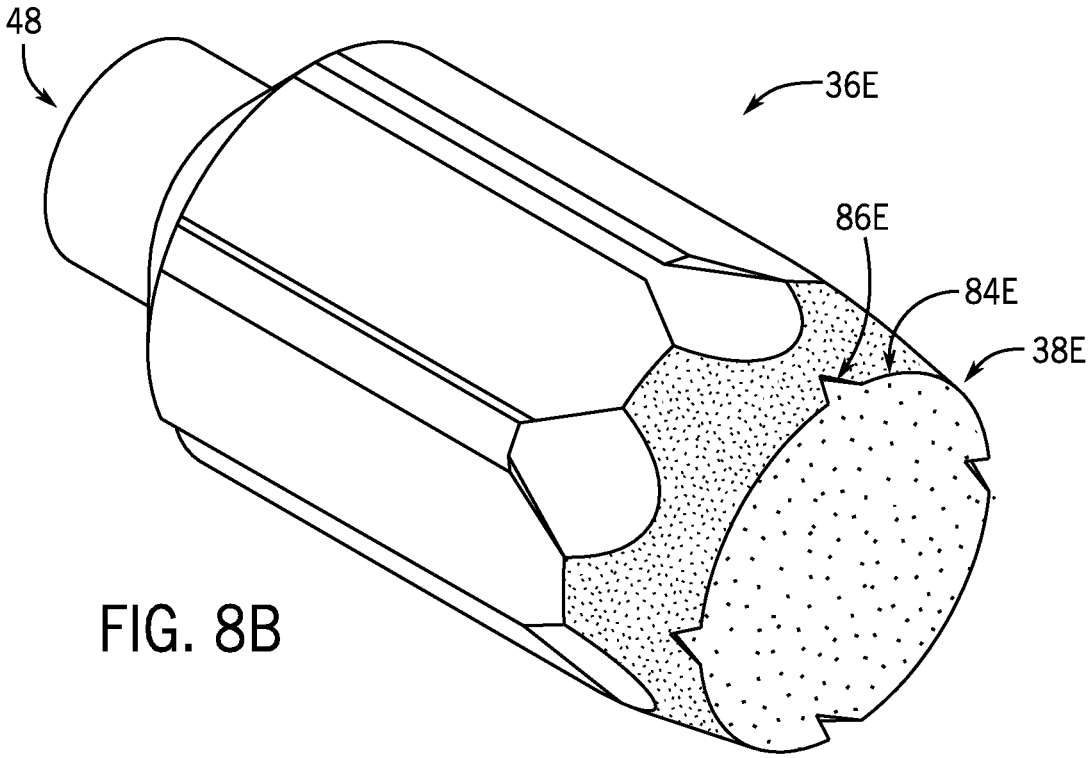
Figure 8C:
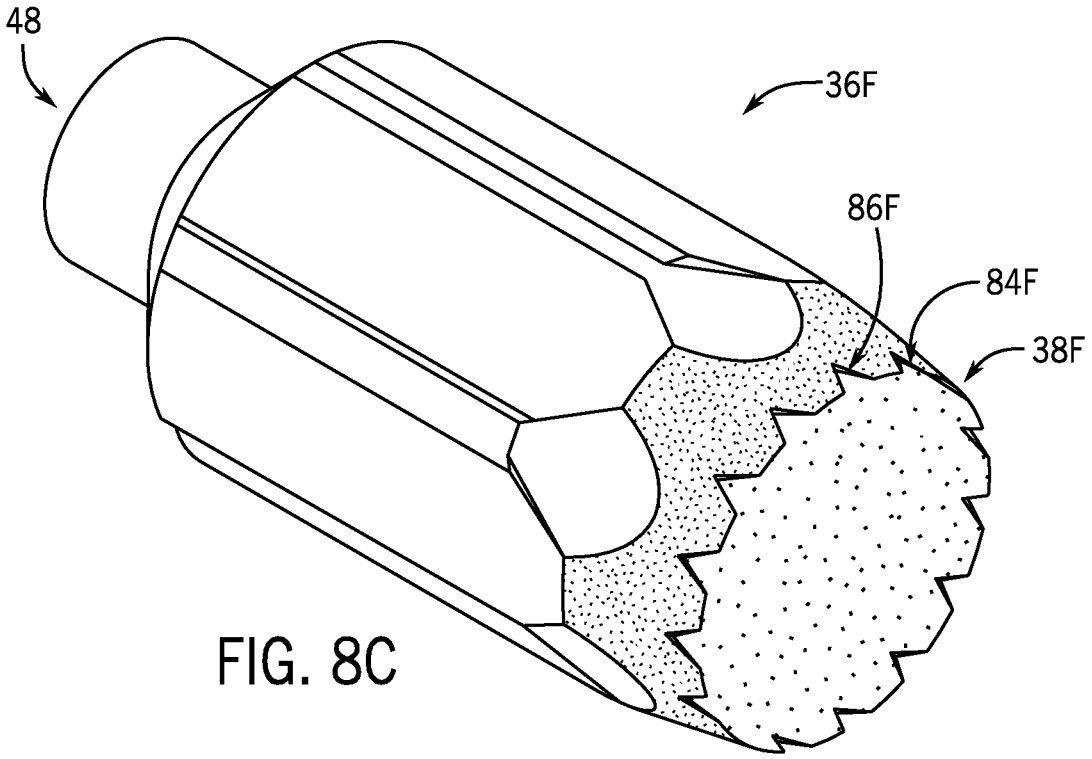

In addition, FIGS. 8A through 8C illustrate various embodiments of coring cylinders 36 having "knife edge" (e.g., triangular) points 38. In particular, FIG. 8A illustrates a coring cylinder 36D having a single (e.g., continuous) knife edge end 38D. In addition, FIGS. 8B and 8C illustrate coring cylinders 36E, 36F having serrated knife edge ends 38E, 38F that include a plurality of knife edge segments 84E, 84F (e.g., serrations or teeth) with corresponding interruptions 86E, 86F between neighboring knife edge segments 84E, 84E. The embodiments illustrated in FIGS. 8B and 8C include coring cylinders 36E, 36F having serrated knife edge ends 38E, 38F that include four knife edge segments 84E and fifteen knife edge segments 84F, respectively. However, in other embodiments, the coring cylinders 36 may have serrated knife edge ends 38 having any number of two or more knife edge segments 84.

Figure 9:
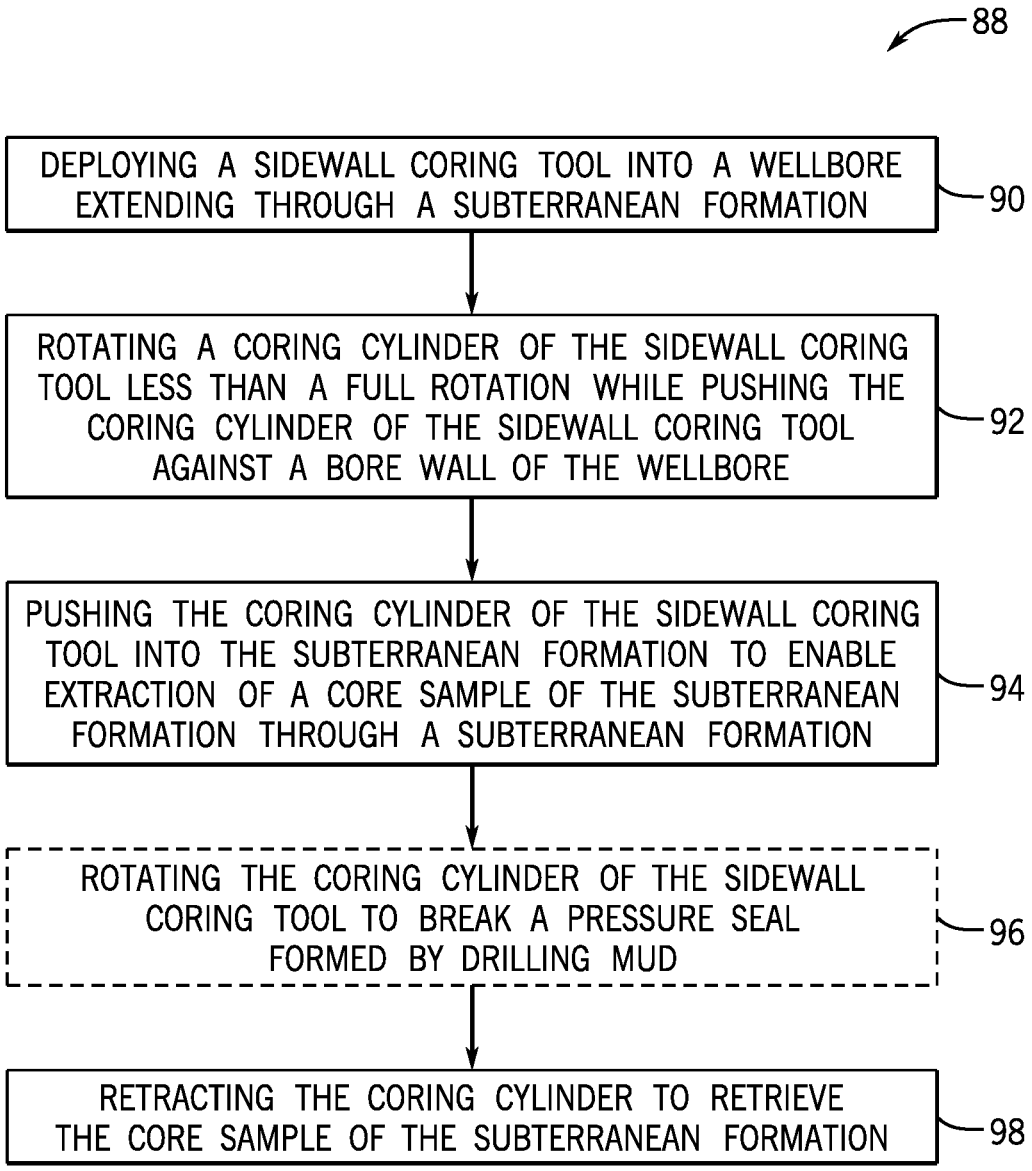
FIG. 9 is a flow diagram of a method of operating sidewall coring tools, according to one or more embodiments of the present disclosure.

FIG. 9 is a flow diagram of a method 88 of operating the sidewall coring tools 12 described herein. In certain embodiments, the method 88 includes deploying a sidewall coring tool 12 into a wellbore 16 extending through a subterranean formation 14 (block 90). In certain embodiments, the method 88 also includes rotating a coring cylinder (e.g., a muleshoe 36, in certain embodiments) of the sidewall coring tool 12 less than a full rotation while pushing the coring cylinder 36 of the sidewall coring tool 12 against a bore wall 18 of the wellbore 16 (block 92). In certain embodiments, the method 88 further includes pushing the coring cylinder 36 of the sidewall coring tool 12 into the subterranean formation 14 to enable extraction of the core sample 66 of the subterranean formation 14 (block 94). In addition, in certain embodiments, the method 88 may optionally include rotating the coring cylinder 36 of the sidewall coring tool 12 to break a pressure seal formed by drilling mud, for example, when such a pressure seal exists (block 96) and the core cannot be extracted due to the pressure differential across such pressure seal. In other embodiments, the pressure seal may be broken using relatively rapid axial movement of the coring cylinder 36 at a relatively small amplitude. In addition, in certain embodiments, the method 88 includes retracting the coring cylinder 36 to retrieve the core sample 66 of the subterranean formation 14 (block 98).

In addition, as described in greater detail herein, the sidewall coring tool 12 includes a coring cylinder 36, and one or more coring actuators 34 configured to rotate the coring cylinder 36 less than a full rotation while pushing the coring cylinder 36 of the sidewall coring tool 12 against a bore wall 18 of a wellbore 16, and to push the coring cylinder 36 of the sidewall coring tool 12 into the subterranean formation 14 to enable extraction of the core sample 66 of the subterranean formation 14. In certain embodiments, the one or more coring actuators 34 are configured to rotate the coring cylinder 36 of the sidewall coring tool 12 back and forth relative to the longitudinal axis 50 less than 90 degrees while pushing the coring cylinder 36 of the sidewall coring tool 12 against the bore wall 18 of the wellbore 16.

In addition, in certain embodiments, the sidewall coring tool 12 includes a single coring actuator 34A coupled to the coring cylinder 36 and configured to directly rotate and push the coring cylinder 36 of the sidewall coring tool 12 into the subterranean formation 14. In other embodiments, the sidewall coring tool 12 includes two opposing coring actuators 34B, 34C configured to indirectly rotate and push the coring cylinder 36 of the sidewall coring tool 12 into the subterranean formation 14 via respective linkages 56B, 56C coupled to the coring actuators 34B, 34C and the coring cylinder 36 of the sidewall coring tool 12. In addition, in certain embodiments, the coring cylinder 36 includes a full muleshoe 36A, a half muleshoe 36B, or other partial muleshoe 36. In addition, in certain embodiments, the coring cylinder 36 includes a knife edge axial end 38C.

In addition, in certain embodiments, a coring system 10 includes a sidewall coring tool 12 having a coring cylinder and one or more coring actuators 34 configured to perform sidewall coring of a subterranean formation 14 using a combination of rotary and percussive coring. In addition, in certain embodiments, the coring system 10 includes a surface unit 22 configured to send control signals to the sidewall coring tool 12 to control the sidewall coring of the subterranean formation 14.

While the present disclosure may be susceptible to various modifications and alternative forms, specific embodiments have been shown by way of example in the drawings and have been described in detail herein. However, it should be understood that the present disclosure is not intended to be limited to the particular forms disclosed. For example, while some embodiments described herein contain specific combinations of coring systems, other combinations may also be possible. Rather, the present disclosure is intended to cover all modifications, equivalents, and alternatives falling within the spirit and scope of the present disclosure as defined by the following appended claims. In particular, it will be appreciated that any and all combinations and sub-combinations of the various features described herein may be included or omitted from any particular embodiment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

deploying a sidewall coring tool into a wellbore extending through a subterranean formation;

rotating a coring cylinder of the sidewall coring tool back and forth less than a full rotation while pushing the coring cylinder of the sidewall coring tool against a bore wall of the wellbore;

pushing the coring cylinder of the sidewall coring tool into the subterranean formation to enable extraction of a core sample of the subterranean formation; and retracting the coring cylinder to retrieve the core sample of the subterranean formation.

2. The method of claim 1, comprising rotating the coring cylinder of the sidewall coring tool to break a pressure seal formed by drilling mud prior to retracting the coring cylinder to retrieve the core sample of the subterranean formation.

3. The method of claim 1, comprising rotating the coring cylinder of the sidewall coring tool back and forth less than 90 degrees while pushing the coring cylinder of the sidewall coring tool against the bore wall of the wellbore.

4. The method of claim 1, wherein the sidewall coring tool comprises one or more actuators configured to rotate and push the coring cylinder of the sidewall coring tool into the subterranean formation.

5. The method of claim 1, wherein the sidewall coring tool comprises a single actuator coupled to the coring cylinder and configured to directly rotate and push the coring cylinder of the sidewall coring tool into the subterranean formation.

6. The method of claim 1, wherein the sidewall coring tool comprises two opposing actuators configured to indirectly rotate and push the coring cylinder of the sidewall coring tool into the subterranean formation via respective linkages coupled to the two opposing actuators and the coring cylinder of the sidewall coring tool.

7. The method of claim 1, wherein the coring cylinder comprises a full muleshoe.

8. The method of claim 1, wherein the coring cylinder comprises a partial muleshoe.

9. The method of claim 1, wherein the coring cylinder comprises a knife edge axial end.

10. The method of claim 9, wherein the knife edge axial end comprises a serrated knife edge axial end having two or more segments.

11. A sidewall coring tool, comprising:

a coring cylinder; and one or more actuators configured to:

rotate the coring cylinder back and forth less than a full rotation while pushing the coring cylinder against a bore wall of a wellbore; and push the coring cylinder into a subterranean formation to enable extraction of a core sample of the subterranean formation.

12. The sidewall coring tool of claim 11, wherein the one or more actuators are configured to rotate the coring cylinder back and forth less than 90 degrees while pushing the coring cylinder against the bore wall of the wellbore.

13. The sidewall coring tool of claim 11, comprising a single actuator coupled to the coring cylinder and configured to directly rotate and push the coring cylinder into the subterranean formation.

14. The sidewall coring tool of claim 11, comprising two opposing actuators configured to indirectly rotate and push the coring cylinder into the subterranean formation via respective linkages coupled to the actuators and the coring cylinder of the sidewall coring tool.

15. The sidewall coring tool of claim 11, wherein the coring cylinder comprises a full muleshoe.

16. The sidewall coring tool of claim 11, wherein the coring cylinder comprises a partial muleshoe.

17. The sidewall coring tool of claim 11, wherein the coring cylinder comprises a knife edge axial end.

18. The sidewall coring tool of claim 17, wherein the knife edge axial end comprises a serrated knife edge axial end having two or more segments.

19. A coring system, comprising:

a sidewall coring tool comprising a coring cylinder and one or more actuators configured to perform sidewall coring of a subterranean formation using a combination of rotary and percussive coring; and a surface unit configured to send control signals to the sidewall coring tool to control the sidewall coring of the subterranean formation, wherein the one or more actuators are configured to rotate the coring cylinder of the sidewall coring tool back and forth less than 90 degrees while pushing the coring cylinder of the sidewall coring tool against a bore wall of a wellbore extending through the subterranean formation.

* * * * *